US007374727B2

(12) United States Patent
Sato et al.

(10) Patent No.: US 7,374,727 B2
(45) Date of Patent: May 20, 2008

(54) EXHAUST-GAS PURIFYING APPARATUS

(75) Inventors: Masayasu Sato, Ogasa-gun (JP); Yasuo Kato, Ogasa-gun (JP); Kazuhiro Kuroda, Ogasa-gun (JP)

(73) Assignee: Cataler Corporation, Shizouka (JP)

( * ) Notice: Subject to any disclaimer, the term of this patent is extended or adjusted under 35 U.S.C. 154(b) by 568 days.

(21) Appl. No.: 10/656,121

(22) Filed: Sep. 8, 2003

(65) Prior Publication Data

US 2004/0096373 A1 May 20, 2004

(30) Foreign Application Priority Data

Nov. 19, 2002 (JP) ..... 2002-335403

(51) Int. Cl.
*B01D 50/00* (2006.01)

(52) U.S. Cl. ..... 422/177

(58) Field of Classification Search ..... 422/168; 431/7; 181/236, 238, 249

See application file for complete search history.

(56) References Cited

U.S. PATENT DOCUMENTS

| | | | | |
|---|---|---|---|---|
| 4,203,502 A | * | 5/1980 | Strader | 181/238 |
| 4,402,662 A | * | 9/1983 | Pfefferle | 431/7 |
| 5,780,386 A | | 7/1998 | Usui | |

FOREIGN PATENT DOCUMENTS

| | | |
|---|---|---|
| GB | 1 374 301 A | 11/1974 |
| JP | 6-343876 | 12/1994 |
| JP | A 9-228832 | 9/1997 |
| JP | A 9-317452 | 12/1997 |
| WO | WO 94/13937 A | 6/1994 |
| WO | WO 99/64732 A | 12/1999 |

* cited by examiner

*Primary Examiner*—Glenn Caldarola
*Assistant Examiner*—Tom Duong
(74) *Attorney, Agent, or Firm*—Oliff & Berridge, PLC

(57) ABSTRACT

An exhaust-gas purifying apparatus includes an outer cylinder, a plurality of cylinder-shaped supports, and a catalytic layer. The cylinder-shaped supports are disposed in the outer cylinder, and have an outer peripheral surface and an inner peripheral surface. At least two of the neighboring cylinder-shaped supports contact with each other with the outer peripheral surfaces. The catalytic layer is loaded on at least one of the outer peripheral surface and inner peripheral surface of the cylinder-shaped supports. At least one of the cylinder-shaped supports has a ring-shaped cross-section with a cut-off, and is disposed in the outer cylinder in such an elastically deformed state that it expands in the centrifugal direction. Thus, the exhaust-gas purifying apparatus not only shows a high exhaust-gas purifying ability, but also is good in terms of the assemblage easiness. Moreover, the exhaust-gas purifying apparatus exhibits improved misfire resistance.

8 Claims, 3 Drawing Sheets

EXHAUST-GAS PURIFYING APPARATUS

BACKGROUND OF THE INVENTION

1. Field of the Invention

The present invention relates to an exhaust-gas purifying apparatus. In particular, it relates to an exhaust-gas purifying apparatus which can be manufactured with ease.

2. Description of the Related Art

In order to purify exhaust gases emitted from automobiles and motorcycles, exhaust-gas purifying apparatuses have been used. There are many types of exhaust-gas purifying apparatuses such as thermal reactor-system, lean burning-system, engine modification-system, and catalyst-system exhaust-gas purifying apparatuses. Among them, catalyst-system exhaust-gas purifying apparatuses have been used extensively.

Catalyst-system exhaust-gas purifying apparatuses purify exhaust gases by using catalytic noble metals such as Pt, Rh and Pd. In catalyst-system exhaust-gas purifying apparatuses, exhaust-gas purifying catalysts are used which are made in the following manner. A loading layer is formed on a surface of a catalyst support with activated alumina such as γ-alumina. Then, one or more catalytic noble metals are loaded on the loading layer.

As for the materials of catalyst supports, heat-resistant materials are used because catalyst supports are exposed to high-temperature exhaust gases. As such materials, it is possible to name ceramics, such as cordierite, heat-resistant metals, such as stainless steels.

Catalyst supports made of ceramics suffer from such disadvantages that they are susceptible to mechanical shocks and exhibit large emission resistance. Accordingly, catalyst supports made of metals have come to be used due to the reasons that the pressure loss of exhaust systems should be reduced or the heat resistance of catalyst supports should be improved.

An exhaust-gas purifying apparatus provided with a metallic catalyst support can be manufactured in the following manner, for example. A steel stock is rolled as a foil-shaped or sheet-shaped workpiece. The steel stock can be SUS304 (as per Japanese Industrial Standard (JIS), i.e., 18Cr—8Ni austenic stainless steel), or SUS430 (as per JIS, i.e., 16Cr ferritic stainless steel). The resulting foil-shaped or sheet-shaped workpiece is processed into a metallic catalyst support. Then, a loading layer is formed on a surface of the resultant metallic catalyst support. Finally, one or more catalytic noble metals are loaded on the loading layer. Thus, an exhaust-gas purifying apparatus provided with a metallic catalyst support is completed.

Depending on the shapes of catalyst supports, exhaust-gas purifying apparatuses can be divided into monolithic, granular, honeycomb-shaped and pipe-shaped exhaust-gas purifying apparatuses.

In honeycomb-shaped exhaust-gas purifying apparatuses, there is a problem in that metallic catalyst supports might be melted by misfires which are transmitted from internal combustion engines. Specifically, when metallic catalyst supports are melted, the effective loading amount of catalytic noble metals might be decreased, or honeycomb-shaped cells might be clogged to lower the exhaust-gas purifying ability of honeycomb-shaped exhaust-gas purifying apparatuses.

Moreover, in pipe-shaped exhaust-gas purifying apparatuses, the axial length should be prolonged in order to secure a desirable exhaust-gas purifying ability. Accordingly, the boardability problem might associate with pipe-shaped exhaust-gas purifying apparatuses. In addition, when the axial length of pipe-shaped exhaust-purifying apparatuses is prolonged, the exhaust-gas temperature might be dropped to lower the exhaust-gas purifying ability of pipe-shaped exhaust-gas purifying apparatuses.

Consequently, pipe-shaped exhaust-gas purifying apparatuses have been developed whose axial length is shortened. For example, Japanese Unexamined Patent Publication (KOKAI) No. 9-228,832 and Japanese Unexamined Patent Publication (KOKAI) No. 9-317,452 propose such a pipe-shaped exhaust-gas purifying apparatus.

Japanese Unexamined Patent Publication (KOKAI) No. 9-228,832 discloses a catalytic converter in which a metallic support, manufactured by winding a corrugated metallic plate, is fitted into an outer cylinder.

However, the catalytic converter disclosed in Japanese Unexamined Patent Publication (KOKAI) No. 9-228,832 suffers from a problem of the bondability between the metallic support and outer cylinder. Specifically, the metallic support is manufactured by winding a corrugated metallic plate. However, at the contacts where the outer peripheral surface of the metallic support contacts with the inner peripheral surface of the outer cylinder, it is difficult to match the curvature of the outer peripheral surface of the metallic support with the curved inner peripheral surface of the outer cylinder. Accordingly, when the metallic support is fitted into the outer cylinder, the metallic support contacts with the outer cylinder by means of point contact. As a result, no sufficient bonding area can be secured between the metallic support and outer cylinder. Thus, there arises the bondability problem.

Japanese Unexamined Patent Publication (KOKAI) No. 9-317,452 discloses an exhaust-gas purifying apparatus in which a plurality of minor-diameter pipes are disposed in a major-diameter pipe.

The exhaust-gas purifying apparatus disclosed in Japanese Unexamined Patent Publication (KOKAI) No. 9-317,452 has a problem in terms the assemblage easiness of the minor-diameter pipes. To put it concretely, the minor-diameter pipes are bonded to the major-diameter pipe by using brazing. However, it has been known that no space is allowed at the bonds between the major-diameter pipe and minor-diameter pipes in the brazing. Accordingly, it is required to manufacture the major-diameter pipe and minor-diameter pipes with high dimensional accuracy. The requirement indicates that it is not possible to use ordinary electrically-seamed pipes. Consequently, in the manufacture of the major-diameter pipe and minor-diameter pipes, it is required to carry out secondary working such as reducing or expanding the major-diameter pipe and minor-diameter pipes diametrically. As a result, the cost of manufacturing the exhaust-gas purifying apparatus disclosed in the publication has gone up.

SUMMARY OF THE INVENTION

The present invention has been developed in view of the aforementioned circumstances. It is therefore an object of the present invention to provide an exhaust-gas purifying apparatus which shows a high purifying ability and which is good in terms of the assemblage easiness.

The inventors of the present invention studied exhaust-gas purifying apparatuses comprising an outer cylinder and a plurality of cylinder-shaped supports wholeheartedly. As a result, they found out that it is possible to achieve the object set forth above when at least one of the cylinder-shaped supports is pressed onto the other cylinder-shaped supports so as to contact the cylinder-shaped supports with each other and/or contact the cylinder-shaped supports with the outer cylinder by means of pressure. Thus, they completed the present invention.

For example, an exhaust-gas purifying apparatus according to the present invention comprises:

an outer cylinder;

a plurality of cylinder-shaped supports disposed in the outer cylinder, and having an outer peripheral surface and an inner peripheral surface, at least two of the neighboring cylinder-shaped supports contacting with each other with the outer peripheral surfaces; and a catalytic layer loaded on at least one of the outer peripheral surface and inner peripheral surface of the cylinder-shaped supports;

wherein at least one of the cylinder-shaped supports has a ring-shaped cross-section with a cut-off, and is disposed in the outer cylinder in such an elastically deformed state that it expands in the centrifugal direction.

In the present exhaust-gas purifying apparatus, the cylinder-shaped support which has a ring-shaped cross-section with a cut-off deforms elastically to expand in the centrifugal direction, thereby pressing the other cylinder-shaped supports. The pressed cylinder-shaped supports contact with the neighboring cylinder-shaped supports and/or the outer cylinder. Specifically, in the present exhaust-gas purifying apparatus, it is possible to manufacture the outer cylinder and cylinder-shaped supports without giving them high dimensional accuracy. Moreover, the present exhaust-gas purifying apparatus can contact with exhaust gases with an enlarged area, because a plurality of the cylinder-shaped supports are disposed in the outer cylinder. As a result, the present exhaust-gas purifying apparatus shows a high exhaust-gas purifying ability, and is good in terms of the assemblage easiness. In addition, when the thickness of the cylinder-shaped supports are thickened, the present exhaust-gas purifying apparatus is improved in terms of the resistance to misfires which are transmitted from internal combustion engines.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
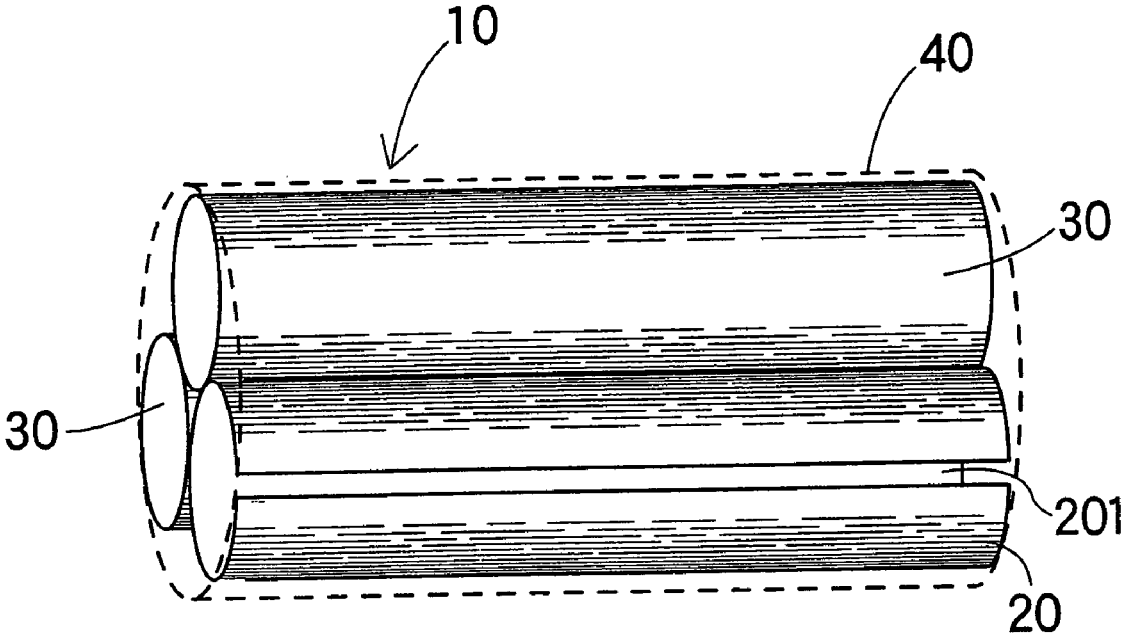
FIG. 1 is a drawing for illustrating the arrangement of an exhaust-gas purifying apparatus according to Example No. 1 of the present invention.

Having generally described the present invention, a further understanding can be obtained by reference to the specific preferred embodiments which are provided herein for the purpose of illustration only and not intended to limit the scope of the appended claims.

The present exhaust-gas purifying apparatus comprises an outer cylinder, a plurality of cylinder-shaped supports, and a catalytic layer. The cylinder-shaped supports are disposed in the outer cylinder, and have an outer peripheral surface and an inner peripheral surface. At least two of the neighboring cylinder-shaped supports contact with each other with the outer peripheral surfaces. The catalytic layer is loaded on at least one of the outer peripheral surface and inner peripheral surface of the cylinder-shaped supports. At least one of the cylinder-shaped supports has a ring-shaped cross-section with a cut-off, and is disposed in the outer cylinder in such an elastically deformed state that it expands in the centrifugal direction.

In the present exhaust-gas purifying apparatus, the catalytic layer is formed on at least one of the outer peripheral surface and inner peripheral surface of the cylinder-shaped supports, and purifies exhaust gases which pass through the inside of the outer cylinder. Since a plurality of the cylinder-shaped substrates with the catalytic layer loaded on at least one of the outer peripheral surface and inner peripheral surface are disposed in the outer cylinder, the catalytic layer contacts with exhaust gases with an enlarged area.

In the present exhaust-gas purifying catalyst, at least one of the cylinder-shaped supports has a ring-shaped cross-section with a cut-off, and is disposed in the outer cylinder in such an elastically deformed state that it expands in the centrifugal direction.

In at least one of the cylinder-shaped supports, the ring-shaped cross-section with a cut-off designates that the vertical cross-section of the cylinder-shaped support, taken vertically with respect to the axial direction, is formed as a ring shape which is cut off partially at least. It is satisfactory that the cylinder-shaped support can be cut off partially at least in the vertical cross-section taken vertically with respect to the axial direction. The cut-off is not limited in terms of the disposition phase in the peripheral direction of the cylinder-shaped support. Specifically, the cut-off can be formed linearly in an inclined manner with respect to the axial direction of the cylinder-shaped support, or can be formed as a curve.

Moreover, in at least one of the cylinder-shaped supports, the ring-shaped cross-section designates that the vertical cross-section of the cylinder-shaped support, taken vertically with respect to the axial direction, forms a ring shape when the cylinder-shaped support is free from the cut-off. Note that the ring-shaped cross-section in the cylinder-shaped support is not limited to a complete ring shape alone, but can be formed as ellipse shapes, or even as rectangle shapes and triangle shapes.

In at least one of the cylinder-shaped supports, the cut-off can preferably be continuous from one of the axial opposite ends of the cylinder-shaped support to the other one of the axial opposite ends. When the cut-off is continuous, the cylinder-shaped support is more likely to expand in the centrifugal direction.

As described above, at least one of the cylinder-shaped supports is disposed in the outer cylinder in such an elastically deformed state that it expands in the centrifugal direction. Specifically, in at least one of the cylinder-shaped supports, a force is exerted so that the ring-shaped cross-section, taken vertically with respect to the axial direction of the cylinder-shaped support, expands in the centrifugal direction in the outer cylinder. The force resulting from the cylinder-shaped support presses the outer peripheral surface of the other neighboring cylinder-shaped supports and/or the inner peripheral surface of the outer cylinder. The thus pressed other cylinder-shaped supports further press the neighboring cylinder-shaped supports. The pressing operations are carried out successively, and thereby a plurality of the cylinder-shaped supports are fastened in the outer cylinder positionally.

Moreover, in the present exhaust-gas purifying apparatus, when a pair of opening ends demarcating the cut-off in the ring-shaped cross-section are brought closer to each other, or when one of the opening ends is protruded toward the axial hollow in the cylinder-shaped support, at least one of the cylinder-shaped supports can be disposed in the outer cylinder with ease in such an elastically deformed state that it expands in the centrifugal direction by simply fitting the thus deformed cylinder-shaped support into the outer cylinder. Note that "a pair of opening ends demarcating the cut-off in the ring-shaped cross-section are brought closer to each other" designates that the distance between the opening ends are reduced, and involves the case as well when the opening ends are contacted with each other. When a pair of the opening ends are brought closer to each other, or when one of the opening ends is protruded toward the axial hollow in the cylinder-shaped support, the diameter of the cylinder-shaped support is reduced. Accordingly, the cylinder-shaped support hardly pressurizes and contacts with the other cylinder-shaped supports when it is fitted into the outer cylinder. Consequently, the cylinder-shaped support can be fitted into the outer cylinder with ease.

The ring-shaped cross-section with the cut-off in at least one of the cylinder-shaped supports can preferably be a letter "C"-shaped cross-section. With such an arrangement, it is possible to manufacture the cylinder-shaped support whose ring-shaped cross-section is provided with the cut-off by simply forming an axial cut-off in the peripheral wall of round pipes. Thus, it is possible to manufacture the cylinder-shaped support easily and less expensively.

The cylinder-shaped supports can preferably be bonded with each other at the contacting outer peripheral surfaces. Moreover, when a plurality of the cylinder-shaped supports are bonded with each other at the contacting outer peripheral surfaces, they are inhibited from displacing positionally with respect to each other, and are inhibited from coming off from the neighboring cylinder-shaped supports. As a result, it is possible to inhibit the catalytic layer loaded on at least one of the outer peripheral surface and inner peripheral surface of the cylinder-shaped supports from being damaged, and thereby it is possible to inhibit the exhaust-gas purifying ability of the catalytic layer from degrading.

The cylinder-shaped supports can preferably contact with an inner peripheral surface of the outer cylinder with the outer peripheral surfaces, and can preferably be bonded to the outer cylinder at the contacting outer peripheral surfaces. With the arrangement, the cylinder-shaped supports are inhibited from displacing positionally in the outer cylinder, and are inhibited from coming off from the outer cylinder.

The outer cylinder and the cylinder-shaped supports can preferably be metallic. When the cylinder-shaped supports are made of a metal, at least one of the cylinder-shaped supports are more likely to elastically deform in the centrifugal direction. When the outer cylinder and cylinder-shaped supports are made of a metal, it is easy to bond the outer cylinder with the cylinder-shaped supports. Moreover, when the outer cylinder and cylinder-shaped supports are made of a metal, the present exhaust-gas purifying apparatus is likely to be heated by exhaust gases, and thereby the catalytic ability of the catalytic layer can be effected quickly immediately after internal combustion engines are started. The metallic material making the outer cylinder and cylinder-shaped supports is not limited in particular. Accordingly, it is possible to use conventionally known metallic materials.

The cylinder-shaped supports can preferably be formed of a perforated steel plate having a plurality of through holes. When the cylinder-shaped supports are formed of such a perforated steel plate, they are provided with holes in addition to the cut-off. When exhaust gases pass through the holes, the exhaust gases are more likely to contact with the catalytic layer, and thereby the exhaust-gas purifying ability of the present exhaust-gas purifying apparatus can be enhanced.

The cylinder-shaped supports can preferably be combined into a plurality of groups, and the groups can be disposed in the outer cylinder at predetermined intervals in the axial direction of the outer cylinder. When the groups of the cylinder-shaped supports are thus disposed in the outer cylinder, the loading amount of the catalytic layer is enlarged. Accordingly, the exhaust-gas purifying ability of the present exhaust-gas purifying apparatus can be upgraded.

The outer cylinder can preferably be an exhaust pipe. When the outer cylinder is an exhaust pipe, it is possible to purify exhaust gases by simply passing exhaust gases through the inside of the outer cylinder.

In the present exhaust-gas purifying apparatus, the catalytic layer is loaded on at least one of the outer peripheral surface and inner peripheral surface of the cylinder-shaped supports. Thus, it is possible to secure the exhaust-gas purifying ability of the present exhaust-gas purifying apparatus by loading the catalytic layer on at least one of the outer peripheral surface and inner peripheral surface of the cylinder-shaped supports. Note that, in the present exhaust-gas purifying apparatus, it is satisfactory as far as the catalytic layer is loaded on at least one of the outer peripheral surface and inner peripheral surface of the cylinder-shaped supports. Moreover, in addition to the outer peripheral surface and inner peripheral surface of the cylinder-shaped supports, a catalytic layer can be further loaded on an inner peripheral surface of the outer cylinder. If such is the case, the present exhaust-gas purifying apparatus can be further improved in terms of the exhaust-gas purifying ability. Accordingly, it is preferable to further load a catalytic layer on the inner peripheral surface of the outer cylinder.

In the present exhaust-gas purifying apparatus, it is possible to use conventionally known catalytic layers for the catalytic layer. The catalytic layer can preferably comprise a loading layer, and a catalytic ingredient loaded on the loading layer.

In exhaust-gas purifying catalysts, loading layers enlarge the contacting area with respect to exhaust gases. In the present exhaust-gas purifying apparatus, it is possible to use heat-resistant inorganic oxides, which have been used in ordinary exhaust-gas purifying catalysts, for the loading layer. For example, the loading layer can preferably comprise a heat-resistant inorganic oxide whose major component is activated alumina. Moreover, the loading layer can preferably further comprise cerium oxide and/or zirconium oxide. When the loading layer comprises the oxides, the present exhaust-gas purifying apparatus is upgraded in terms of the exhaust-gas purifying characteristic. In addition, the thickness of the loading layer is not limited in particular, but can be controlled appropriately depending on the usage of the present exhaust-gas purifying apparatus.

The catalytic ingredient is loaded on the loading layer. The catalytic ingredient can be loaded on the loading layer after the loading layer is formed, or can be included in the loading layer simultaneously with the formation of the loading layer by mixing the catalytic ingredient with a slurry composed of activated alumina and by coating the resulting mixture slurry on at least one of the outer peripheral surface and inner peripheral surface of the cylinder-shaped supports. In exhaust-gas purifying catalysts, catalytic ingredients are components which purify exhaust gases. Accordingly, it is possible to use catalytic ingredients, which have been used in ordinary exhaust-gas purifying catalysts, for the catalytic ingredient. For instance, it is possible to use either one of oxidizing catalysts, reducing catalysts and 3-way catalysts.

Specifically, when at least one member selected from the group consisting of platinum (Pt), palladium (Pd) and rhodium (Rh) is used for the catalytic ingredient, it is possible to efficiently purify carbon monoxide (CO), hydrocarbons (HC) and nitrogen oxides ($NO_x$). Moreover, the loading amount of the catalytic ingredient is not limited in particular, but can be controlled appropriately depending on the usage of the present exhaust-gas purifying apparatus.

EXAMPLES

Hereinafter, the present invention will be described in more detail with reference to specific examples. Pipe-shaped exhaust-gas purifying apparatuses, examples of the present invention, were manufactured as described below.

Example No. 1

First of all, a cylinder-shaped support 20 whose axially vertical cross-section was formed as a letter "C" shape was manufactured in the following manner. A round pipe was prepared. The round pipe had an outside diameter of ϕ 19 mm, a length of 90 mm and a thickness of 0.6 mm, and was composed of SUS304 (as per JIS). The round pipe was cut off at a portion in the peripheral wall continuously in the axial direction, thereby forming an opening 201. Note that the opening 201 had a peripheral length of 2 mm. The peripheral length can preferably be from 1/100 to 10/100, further preferably from 1/100 to 5/100, of the entire peripheral length of the round pipe or cylinder-shaped support 20.

Then, two cylinder-shaped supports 30, 30 whose axially vertical cross-section was formed as a ring were prepared. The cylinder-shaped supports 30, 30 had an outside diameter of ϕ 19 mm, a length of 90 mm and a thickness of 0.6 mm, and were composed of SUS304 (as per JIS). Moreover, an outer cylinder 40 was prepared. The outer cylinder 40 had an outside diameter of ϕ 42.7 mm, a length of 90 mm and a thickness of 1.2 mm, and was composed of SUS304 (as per JIS). Together with the cylinder-shaped support 20 whose axially vertical cross-section was formed as a letter "C" shape, the two cylinder-shaped supports 30, 30 whose axially vertical cross-section was formed as a ring shape were fitted into the outer cylinder 40. When the cylinder-shaped supports 20, 30 and 30 were fitted into the outer cylinder 40, the opening 201 of the cylinder-shaped support 20 was contracted. Namely, since the cylinder-shaped support 20 with a letter "C"-shaped axially vertical cross-section was thus contracted diametrically, the cylinder-shaped supports 20, 30 and 30 could be fitted into the outer cylinder 40 with ease. Moreover, when the cylinder-shaped support 20 with a letter "C"-shaped axially vertical cross-section was fitted into and positioned in the outer cylinder 40, a force expanding the cylinder-shaped support 20 in the centrifugal direction was generated by elastic deformation. Accordingly, the cylinder-shaped support 20 contacted with the inner peripheral surface of the outer cylinder 40 by pressure, and contacted with the outer peripheral surface of the cylinder-shaped supports 30, 30 with a ring-shaped axially vertical cross-section by pressure. In addition, due to the stress exerted from the cylinder-shaped support 20 with a letter "C"-shaped axially vertical cross-section, the two cylinder-shaped supports 30, 30 with a ring-shaped axially vertical cross-section contacted with the inner peripheral surface of the outer cylinder 40 by pressure, and contacted with the outer peripheral surface of the neighboring cylinder-shaped supports 20, 30 by pressure.

Subsequently, the respective contacts between the three cylinder-shaped supports 20, 30 and 30 and the outer cylinder 40 were brazed with an Ni brazing alloy. By the brazing, the three cylinder-shaped supports 20, 30 and 30 and the outer cylinder 40 were bonded.

In the meantime, a slurry was prepared by uniformly mixing activated alumina, a Ce—Zr composite oxide, a binder, Pt, Rh and water. The activated alumina was $\gamma$-$Al_2O_3$, and was used in an amount of 57.6 parts by weight. The Ce—Zr composite oxide was used in an amount of 32.4 parts by weight. Note that the amount of the Ce—Zr composite oxide could be 27.5 parts by weight by conversion into $CeO_2$. The binder was used in an amount of 5.8 parts by weight. Pt was used in an amount of 3.6 parts by weight. Rh was used in an amount of 0.7 parts by weight. The water was used in an amount of 250 parts by weight.

The resultant slurry was coated on the inner peripheral surface of the outer cylinder 40 and the outer peripheral surface and inner peripheral surface of the cylinder-shaped supports 20, 30 and 30. Note that the coating amount was 90 $g/m^2$. Thereafter, the coated slurry was calcined at 500° C. for 1 hour.

In accordance with the above-described procedures, a pipe-shaped exhaust-gas purifying apparatus 10 according to Example No. 1 was manufactured. FIG. 1 illustrates the arrangement of the pipe-shaped exhaust-gas purifying apparatus 10 according to Example No. 1. Note that, in the drawing, the outer cylinder 40 is illustrated with broken lines in order to make the dispositions of the cylinder-shaped supports 20, 30 and 30 noticeable in the pipe-shaped exhaust-gas purifying apparatus 10 according to Example No. 1.

Example No. 2

Except that a perforated steel pipe was used to prepare three cylinder-shaped supports 21, 31 and 31 which were disposed in an outer cylinder 41, a pipe-shaped exhaust-gas purifying apparatus 11 according to Example No. 2 was manufactured in the same manner as Example No. 1.

Specifically, in the pipe-shaped exhaust-gas purifying apparatus 11 according to Example No. 2, the three cylinder-shaped supports 21, 31 and 31 which were fastened in the outer cylinder 41 were made of a perforated steel pipe, respectively. Among the cylinder-shaped supports 21, 31 and 31, the cylinder-shaped support 21 was provided with a letter "C"-shaped axially vertical cross-section.

Figure 2:
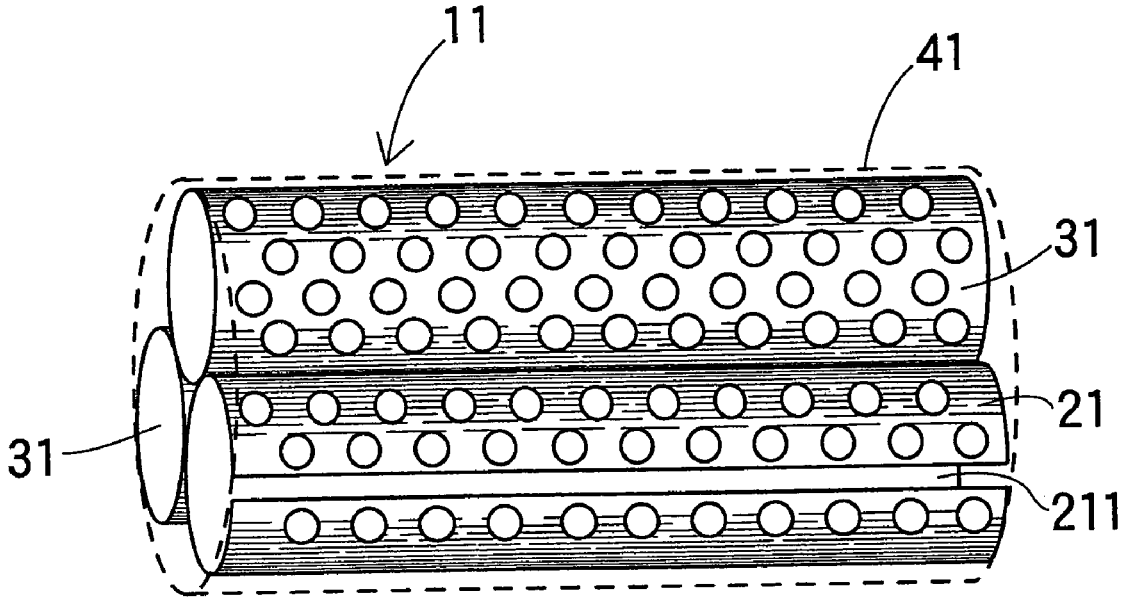
FIG. 2 is a drawing for illustrating the arrangement of an exhaust-gas purifying apparatus according to Example No. 2 of the present invention.

FIG. 2 illustrates the arrangement of the pipe-shaped exhaust-gas purifying apparatus 11 according to Example No. 2. Note that, in the drawing, the outer cylinder 41 is illustrated with broken lines in order to make the dispositions of the cylinder-shaped supports 21, 31 and 31 noticeable in the pipe-shaped exhaust-gas purifying apparatus 11 according to Example No. 1.

Example No. 3

First of all, a cylinder-shaped support 22 whose axially vertical cross-section was formed as a letter "C" shape was manufactured in the following manner. A round pipe was prepared. The round pipe had an outside diameter of ϕ 19 mm, a length of 90 mm and a thickness of 0.6 mm, and was composed of SUS304 (as per JIS). The round pipe was cut off at a portion in the peripheral wall continuously in the axial direction, thereby forming an opening 221. Note that the opening 221 had a peripheral length of 2 mm.

Then, two cylinder-shaped supports 32, 32 whose axially vertical cross-section was formed as a ring were prepared. The cylinder-shaped supports 32, 32 had an outside diameter of ϕ 19 mm, a length of 90 mm and a thickness of 0.6 mm, and were composed of SUS304 (as per JIS). Moreover, an outer cylinder 42 was prepared. The outer cylinder 42 had an outside diameter of ϕ 42.7 mm, a length of 90 mm and a thickness of 1.2 mm, and was composed of SUS304 (as per JIS). Together with the cylinder-shaped support 22 whose axially vertical cross-section was formed as a letter "C" shape, the two cylinder-shaped supports 32, 32 whose axially vertical cross-section was formed as a ring shape were fitted into the outer cylinder 42. When the three cylinder-shaped supports 22, 32 and 32 were fitted into the outer cylinder 42, they were disposed in the middle of the outer cylinder 42 in the axial direction of the outer cylinder 42.

Moreover, two sets of the cylinder-shaped supports 22, 32 and 32 were prepared. Specifically, a set of the cylinder-shaped support 22, 32 and 32 comprised a cylinder-shaped support 22 whose axially vertical cross-section was formed as a letter "C" shape, and two cylinder-shaped supports 32, 32 whose axially vertical cross-section was formed as a ring shape. One of the sets was fitted into the outer cylinder 42 from one of the opposite opening ends of the outer cylinder 42. The other one of the sets was fitted into the outer cylinder 42 from the other one of the opposite opening ends of the outer cylinder 42. When the three sets of the cylinder-shaped supports 22, 32 and 32 were fitted into the outer cylinder 42, they were disposed out of phase, or their disposition phases did not agree with each other in the outer cylinder 42. Specifically, the three sets of the cylinder-shaped supports 22, 32 and 32 were disposed in the outer cylinder 42 so that their axial dispositions did not agree with each other in the outer cylinder 42. In other words, the three sets of the cylinder-shaped supports 22, 32 and 32 were disposed in a staggered manner in the axial direction of the outer cylinder 42.

Note that it was possible to fit the cylinder-shaped supports 22, 32 and 32, nine pieces in total, into the outer cylinder 42 with ease as it was possible to do so in Example No. 1.

Subsequently, in the same manner as Example No. 1, the cylinder-shaped supports 22, 32 and 32 were brazed with each other, were brazed to the outer cylinder 42 as well, and were thereafter provided with a catalytic layer, respectively.

Figure 3:
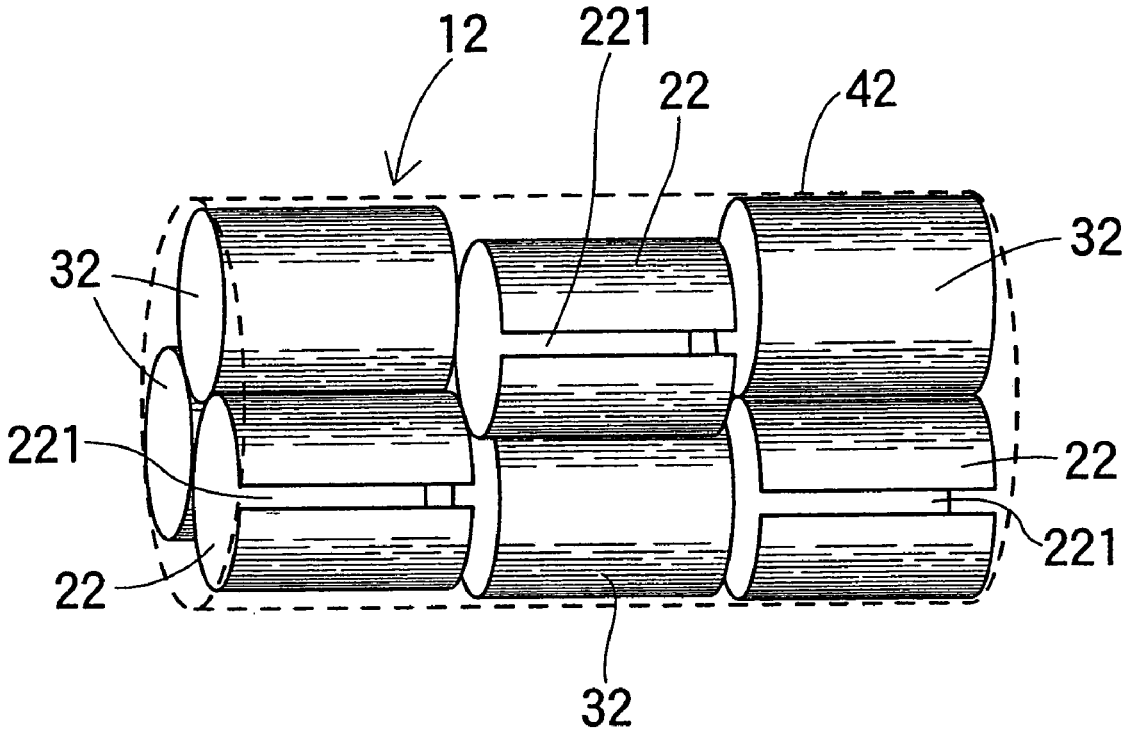
FIG. 3 is a drawing for illustrating the arrangement of an exhaust-gas purifying apparatus according to Example No. 3 of the present invention.

In accordance with the above-described procedures, a pipe-shaped exhaust-gas purifying apparatus 12 according to Example No. 3 was manufactured. FIG. 3 illustrates the arrangement of the pipe-shaped exhaust-gas purifying apparatus 12 according to Example No. 3. Note that, in the drawing, the outer cylinder 42 is illustrated with broken lines in order to make the dispositions of the cylinder-shaped supports 22, 32 and 32 noticeable in the pipe-shaped exhaust-gas purifying apparatus 12 according to Example No. 3.

Example No. 4

Except that a perforated steel pipe was used to prepare nine cylinder-shaped supports 23, 33 and 33 which were disposed in an outer cylinder 43, a pipe-shaped exhaust-gas purifying apparatus 13 according to Example No. 4 was manufactured in the same manner as Example No. 3.

Specifically, in the pipe-shaped exhaust-gas purifying apparatus 13 according to Example No. 4, the nine cylinder-shaped supports 23, 33 and 33 which were fastened in the outer cylinder 43 were made of a perforated steel pipe, respectively. In each set of the three cylinder-shaped supports 23, 33 and 33 which are disposed at the same axial position in the outer cylinder 43, only the cylinder-shaped support 23 was provided with a letter "C"-shaped axially vertical cross-section.

Figure 4:
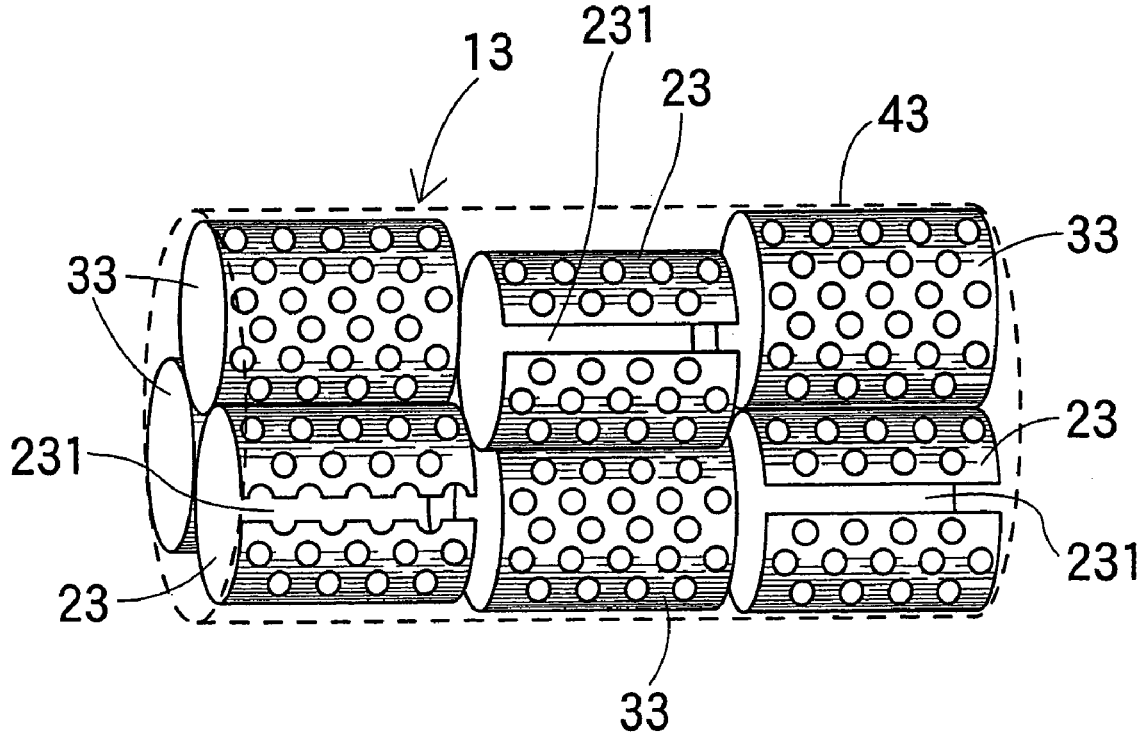
FIG. 4 is a drawing for illustrating the arrangement of an exhaust-gas purifying apparatus according to Example No. 4 of the present invention.

FIG. 4 illustrates the arrangement of the pipe-shaped exhaust-gas purifying apparatus 13 according to Example No. 4. Note that, in the drawing, the outer cylinder 43 is illustrated with broken lines in order to make the dispositions of the cylinder-shaped supports 23, 33 and 33 noticeable in the pipe-shaped exhaust-gas purifying apparatus 13 according to Example No. 4.

When manufacturing the pipe-shaped exhaust-purifying apparatuses 10 through 13 according to Example Nos. 1 through 4, it was possible to fit the cylinder-shaped supports into the outer cylinder with ease. Moreover, when the cylinder-shaped supports were fitted into and disposed in the outer cylinder, the cylinder-shaped supports fastened of themselves to the outer cylinder. Accordingly, in the brazing operation, it was not needed to temporarily fasten the cylinder-shaped supports to the outer cylinder. Consequently, it was possible to sharply reduce the costs for manufacturing the pipe-shaped exhaust-purifying apparatuses 10 through 13 according to Example Nos. 1 through 4.

Comparative Example

An exhaust-gas purifying apparatus according to Comparative Example was manufactured in the following manner. A metallic honeycomb-shaped support was made of an outer cylinder, a corrugated foil, and a flat foil. The outer cylinder had an outside diameter of ϕ 42.7 mm, a length of 90 mm and a thickness of 1.2 mm, and was composed of SUS436L (as per JIS). The corrugated and flat foils had a thickness of 0.1 mm, and were composed of 20Cr-5Al heat-resistant steel. The metallic honeycomb-shaped support had 15.5 cells per 1 $cm^2$ (i.e., 100 cells/$in^2$ approximately). The metallic honeycomb-shaped support was provided with a catalytic layer in the same manner as Example No. 1.

Assessment

In order to asses the present exhaust-gas purifying apparatus, the exhaust-gas purifying apparatuses according to Example No. 4 and Comparative Example were subjected to a misfire resistance test. The misfire resistance test was carried out as hereinafter described. The respective exhaust-gas purifying apparatuses were installed to an exhaust system of a motorbike on which a 4-stroke engine was boarded. The engine had a displacement of 0.400 L (or 400 cc). The engine was driven under a constant-speed condition, i.e., at a speed of 60 km/h (or at the 4th speed, or at 3, 600 rpm), and was thereafter stopped compulsorily by turning off the ignition switch. Thus, a misfire occurred. In the misfire resistance test, the exhaust-gas purifying apparatuses were assessed when the engine was stopped forcibly once and for all.

Figure 5:
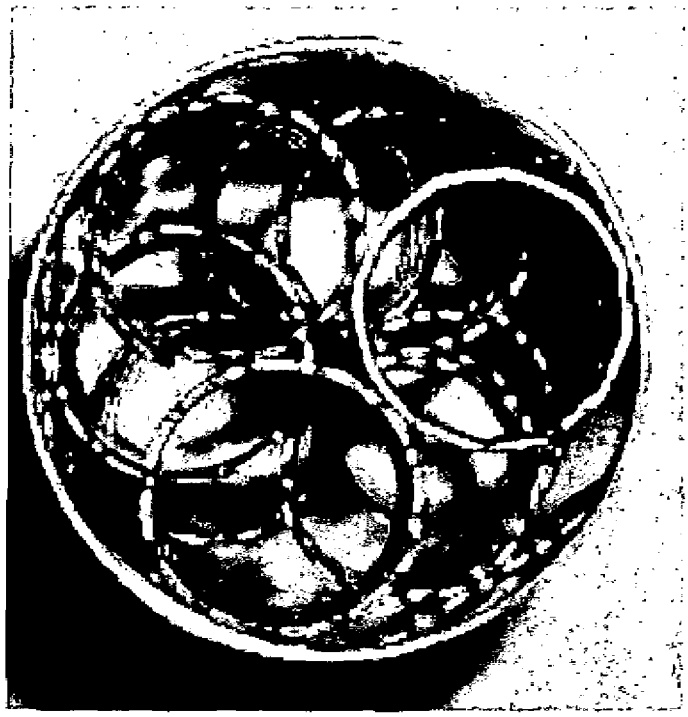
FIG. 5 is an image for depicting the exhaust-gas purifying apparatus according to Example No. 4 after it was subjected to a misfire resistance test.
Figure 6:
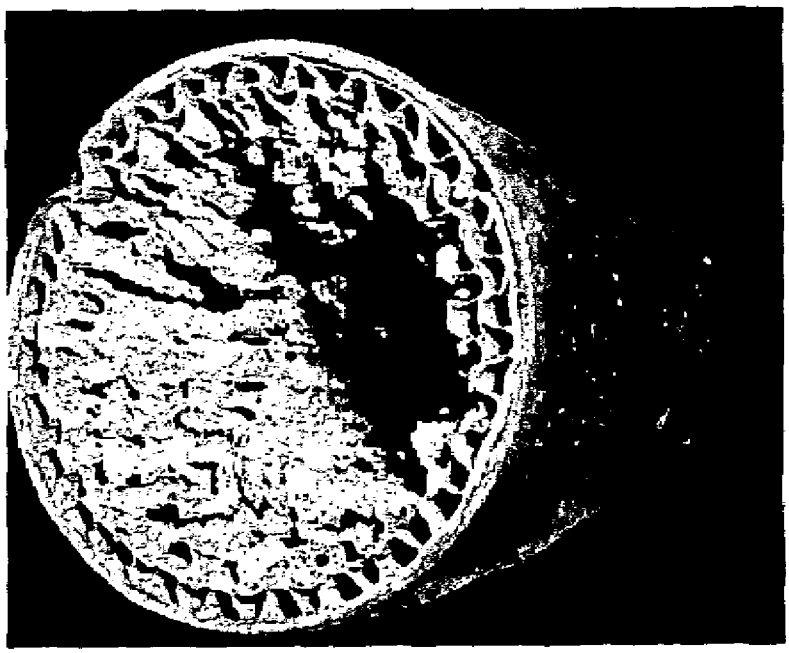
FIG. 6 is an image for depicting an exhaust-gas purifying apparatus according to Comparative Example after it was subjected to a misfire resistance test.

Thereafter, the pipe-shaped exhaust-gas purifying apparatuses according to Example No. 4 and Comparative Example were removed from the exhaust system of the motorbike, and were examined visually how they were affected by the misfire. The pipe-shape exhaust-gas purifying apparatuses were photographed after the misfire resistance test. FIG. 5 shows the appearance of the pipe-shaped exhaust-gas purifying apparatus 13 according to Example No. 4 after the misfire resistance test. FIG. 6 shows the appearance of the honeycomb-shaped exhaust-gas purifying apparatus according to Comparative Example after the misfire resistance test.

It is verified from FIG. 6 that the honeycomb-shaped exhaust-gas purifying apparatus according to Comparative Example was melted and damaged by the misfire. On the other hand, as shown in FIG. 5, it is possible to recognize that the pipe-shaped exhaust-gas purifying apparatus 13 according to Example No. 4 was scarcely melted and damaged by the misfire. Specifically, in the honeycomb-shaped exhaust-gas purifying apparatus according to Comparative Example, the thickness of the foil demarcating the cellular walls was so thin that the cellular walls were melted and damaged by the heat resulting from the misfire. On the contrary, in the pipe-shaped exhaust-gas purifying apparatus 13 according to Example No. 4, the thickness of the cylinder-shaped supports 23, 33 and 33 was so thick that the cylinder-shaped supports 23, 33 and 33 were hardly melted and damaged even when they were exposed to the misfire.

Thus, in the pipe-shaped exhaust-gas purifying apparatus 13 according to Example No. 4, it was possible to provide the cylinder-shaped supports 23, 33 and 33 with a heavy thickness. As a result, the pipe-shaped exhaust-gas purifying apparatus 13 exhibited high misfire resistance. Note that it is preferable to control the thickness of the cylinder-shaped supports 0.3 mm or more, further preferably in a range of from 0.3 to 1.0 mm.

As described above, the pipe-shaped exhaust-gas purifying apparatuses 10 through 13 according to Example Nos. 1 through 4 produced advantages that not only they could be manufactured at reduced costs and had a high exhaust-gas purifying ability, but also they exhibited enhanced misfire resistance.

Having now fully described the present invention, it will be apparent to one of ordinary skill in the art that many changes and modifications can be made thereto without departing from the spirit or scope of the present invention as set forth herein including the appended claims.

What is claimed is:

1. An exhaust-gas purifying apparatus, comprising:

an outer cylinder;

a plurality of cylinder-shaped supports disposed in the outer cylinder, and having an outer peripheral surface and an inner peripheral surface, at least two of the neighboring cylinder-shaped supports contacting with each other with the outer peripheral surfaces; and a catalytic layer loaded on at least one of the outer peripheral surface and inner peripheral surface of the cylinder-shaped supports, wherein the cylinder-shaped supports in contact, but not fitted into the outer cylinder, are inscribed in a circle having a diameter superior to an inside diameter of the outer cylinder, at least one of the cylinder-shaped supports has a ring-shaped cross-section with a cut-off having a peripheral length such that when the at least one of the cylinder-shaped supports is in elastically deformed state, the cylinder-shaped supports are inscribed in a circle having a diameter inferior to the inside diameter of the outer cylinder, wherein the cylinder-shaped supports are combined into a plurality of groups, and the groups are disposed in the outer cylinder at predetermined intervals in the axial direction of the outer cylinder and the groups of the cylinder-shaped supports are disposed out of phase in the axial direction of the outer cylinder.

2. The exhaust-gas purifying apparatus set forth in claim 1, wherein the ring-shaped cross-section with a cut-off is a letter "C"-shaped cross-section.

3. The exhaust-gas purifying apparatus set forth in claim 1, wherein the cylinder-shaped supports are bonded with each other at the contacting outer peripheral surfaces.

4. The exhaust-gas purifying apparatus set forth in claim 1, wherein the cylinder-shaped supports contact with an inner peripheral surface of the outer cylinder with the outer peripheral surfaces, and are bonded to the outer cylinder at the contacting outer peripheral surfaces.

5. The exhaust-gas purifying apparatus set forth in claim 1, the outer cylinder and the cylinder-shaped supports are metallic.

6. The exhaust-gas purifying apparatus set forth in claim 5, wherein the cylinder-shaped supports are formed of a perforated steel plate having a plurality of through holes.

7. The exhaust-gas purifying apparatus set forth in claim 1, wherein the cut-off is continuous from one of the axial opposite ends of at least one of the cylinder-shaped supports to the other one of the axial opposite ends thereof.

8. The exhaust-gas purifying apparatus set forth in claim 1, wherein the outer cylinder is an exhaust pipe.

* * * * *